US006316394B1

(12) United States Patent
Morgan et al.

(10) Patent No.: US 6,316,394 B1
(45) Date of Patent: Nov. 13, 2001

(54) MACHINING FLUID AND METHOD OF MACHINING

(75) Inventors: Myrna J. Morgan, Bethel; Deli Gong, Cincinnati, both of OH (US)

(73) Assignee: Milacron Inc., OH (US)

( * ) Notice: Subject to any disclaimer, the term of this patent is extended or adjusted under 35 U.S.C. 154(b) by 0 days.

(21) Appl. No.: 09/771,267

(22) Filed: Jan. 29, 2001

(51) Int. Cl.[7] ..... C10M 141/02

(52) U.S. Cl. ..... 508/429; 508/431; 508/440; 72/42

(58) Field of Search ..... 508/429, 431, 508/440; 72/42

(56) References Cited

U.S. PATENT DOCUMENTS 4,177,154 * 12/1979 Chakrabarti ..... 508/429
4,511,480 * 4/1985 Outlaw et al. ..... 252/389
5,391,310 * 2/1995 Krueger et al. ..... 508/429
5,706,684 * 1/1998 Gong et al. ..... 508/429
5,874,390 * 2/1999 Gong et al. ..... 508/273

* cited by examiner

*Primary Examiner*—Jacqueline V. Howard
(74) *Attorney, Agent, or Firm*—John W. Gregg; Donald Dunn

(57) ABSTRACT

A synthetic aqueous machining fluid admixture, that is free of sulfur containing and chlorine containing lubricants, and usable in heavy duty machining (e.g. stamping, punching and drawing) operations comprises a) water, b) a water soluble or dispersible fatty acid or water soluble or dispersible fatty acid salt, c) a water soluble or dispersible ethylene oxide propylene oxide copolymer having at least one terminal hydroxyl group or water soluble or dispersible derivative of an ethylene oxide propylene oxide copolymer and d) a water soluble or dispersible organic phosphate ester. Methods for heavy duty machining comprise the steps of applying a force to a workpiece by a tool contacting the workpiece and applying the synthetic aqueous fluid admixture to the interface between the tool and workpiece. The fluid exhibits safety and environmental advantages in use compared to prior art fluids comprising vanishing oils while providing equal or superior lubricity.

40 Claims, No Drawings

MACHINING FLUID AND METHOD OF MACHINING

FIELD OF INVENTION

This invention relates to the art of aqueous based machining fluids and more particularly to aqueous based synthetic machining fluids suitable for use in heavy duty metalworking operations and to machining methods employing the aqueous based synthetic machining fluid.

BACKGROUND OF THE INVENTION

Heavy duty machining and working operations to which the invention pertains are characterized by use of relatively high forces to shape workpieces both by cutting and non-cutting processes. Such operations include non-cutting shaping processes such as forging, stamping, spinning, extruding, rolling, drawing and ironing and cutting processes such as punching, shearing, and broaching, as well as high force drilling, grinding, milling and turning processes. Characteristic of heavy duty machining operations, work done on the workpiece together with friction between the tool and workpiece generate sufficient heat to distort the workpiece and cause high rates of tool wear. Hence, it is well known in the art of such heavy duty machining operations to apply a machining fluid (e.g. metalworking fluid) composition to the interface between the tool and the workpiece to reduce friction and remove heat.

Machining fluids are generally broadly classified into two categories: non-aqueous (i.e. oils); and, aqueous (i.e. water based). As oil based fluids are known to pose difficulties relating to disposal, in-use mist generation, and flammability, there is an increasing demand for aqueous based fluids for use in heavy duty machining operations.

Aqueous based machining fluids are complex combinations of water, lubricants and additives such as for example extreme pressure agents, surfactants, corrosion inhibitors, fungicides, bactericides, antifoam agents and settling agents. Aqueous based machining fluids are known in the art to be classified into soluble oils, synthetic and semi-synthetic types. Of these types, only synthetic fluids are characterized as true solutions, soluble oils employing special mineral oil that disperses in water to form an opaque emulsion, and semi-synthetics comprising emulsions of oil and water made transparent or translucent by use of high concentrations of emulsifiers (see *Tooling and Production* March 1986, p. 38). It is well known that fluids containing components tending to emulsify petroleum oils are prone to emulsify tramp oils (i.e. oils leaking from and around machine tools) that contribute to generation of mists in use and to increased susceptibility to the growth of bacteria and fungi in the fluid.

As synthetic type aqueous machining fluids generally do not contain such petroleum oil emulsifying components, such fluids are less likely to emulsify tramp oils. Additionally synthetic type aqueous machining fluids have often been found to permit easier cleanup in and around machining operations as well as easier cleanup of the machined parts. These advantages have led to an increased utilization of synthetic type aqueous machining fluids (e.g. metalworking fluids) in metalworking processes. While synthetic type aqueous metalworking fluids have been successfully used in light duty metalworking processes (i.e. processes employing relatively low mechanical forces), known synthetic type aqueous fluids lack lubricity comparable to fluids known for heavy duty machining processes. In particular, fluids known for heavy duty machining processes commonly include chlorine and/or sulfur containing lubricants which are only slightly soluble in water and, hence, are absent in synthetic fluids. Thus there has been and continues to be the need for improving the performance of synthetic type aqueous machining fluids especially in relation to their use in heavy duty metalworking processes.

The art has used various approaches to improve aqueous machining fluids for use in heavy duty metalworking processes. A combination of a water soluble polyoxypropylene/polyoxyethylene glycol block copolymer and a water emulsifiable high pressure chlorinated paraffin, sulfurized ester of fatty acid or chlorinated ester of fatty acid lubricant in an aqueous metalworking fluid has been proposed in U.S. Pat. No. 4,212,750. In U.S. Pat. No. 3,995,465 a water based cold forming lubricant containing a block copolymer having a polyoxypropylene center moiety with oxyethylene grafted on to its ends which precipitates out of solution at elevated temperatures in combination with an alkali saponified sulfurized or chlorinated triglyceride is described. An aqueous solution or emulsion functional fluid (e.g. cutting fluid) employing an alkenyl substituted carboxylic agent/hydroxy terminated polyoxyalkylene reaction product thickening agent is proposed in U.S. Pat. No. 4,659,492. A water based metalworking lubricant containing a water soluble oxyalkylene derivative of an amine (e.g. polyalkylene polyamine, alkyl amine, alkaryl amine and carboxylic acid amine) and a phosphorus bearing acid or derivative thereof (e.g. butyl acid phosphate, phosphoric acid and butyl phosphonic acid) or boric acid is described in U.S. Pat. No. 4,626,367. A completely hydrophilic phosphated polyethoxylated n-butane-1,4-diol in a synthetic aqueous metalworking fluid has been proposed in U.S. Pat. No. 4,177,154.

It is also known in the art of emulsion type aqueous metalworking fluids, e.g. U.S. Pat. No. 5,706,684, to employ sulfurized and/or chlorinated lubricants (e.g. sulfurized olefin) as extreme pressure lubricants in combination with fatty acids (e.g. tall oil fatty acid) or fatty acid salts (e.g. alkanolamine salt of stearic acid) and ethylene oxide/propylene oxide copolymers having at least one terminal hydroxyl group and organic phosphates (e.g. poly-(1,2-ethanediyl) alpha-isodecyl-omega hydroxy phosphate) for heavy duty machining of metals. Such known aqueous metalworking fluids are known to exhibit such draw backs as emulsifying tramp oil contaminants, staining metal parts and leaving residues which are difficult to wash off, potentially interfering with subsequent coating, plating, and joining processes.

It is therefore an object of this invention to provide a synthetic aqueous machining fluid for improving mechanical working and shaping processes on metallic and non-metallic workpieces. Another object of this invention is to provide a synthetic aqueous machining fluid for improving heavy duty mechanical working and shaping processes on metallic workpieces. A further object of this invention is to provide a synthetic aqueous machining fluid having improved lubricity especially usable in heavy duty mechanical working and shaping processes on metallic workpieces. A still further object of this invention is to provide a synthetic aqueous machining fluid overcoming disadvantages of prior art aqueous and non-aqueous oil based machining fluids. A still further object of this invention is to provide improved methods of machining employing synthetic aqueous machining fluids in accordance with the invention.

SUMMARY OF INVENTION

These and other objects, as will be apparent to those skilled in the art from the following description and claims, are achieved by the aqueous machining fluid composition of this invention. In accordance with this invention there is provided a synthetic aqueous machining fluid composition admixture free of sulfurized organic lubricant and free of halogenated (e.g. chlorinated) organic lubricant and suitable for use in heavy duty machining processes. The aqueous synthetic machining fluid admixture in accordance with this invention, by virtue of its resistance to emulsifying tramp oil, advantageously resists tramp oil contamination. The synthetic aqueous machining fluid in accordance with the invention has been observed to leave little or no evaporation residue, reducing or eliminating the need for washing workpieces intended for subsequent coating (e.g. painting), plating or joining (e.g. welding) operations.

There is now provided in accordance with this invention a synthetic aqueous machining fluid admixture that is free of sulfur and/or halogen containing organic lubricants comprising water, a water soluble or dispersible fatty acid or fatty acid salt, a water soluble or dispersible propylene oxide terminated ethylene oxide/propylene oxide copolymer having at least one terminal hydroxyl group or water soluble derivative thereof, and a water soluble or dispersible organic phosphate ester.

There is further provided in accordance with this invention a method for mechanically shaping an article comprising the steps of a) applying force to a workpiece by a tool contacting the workpiece and b) supplying to the interface between the tool and the workpiece a synthetic aqueous machining fluid admixture free of sulfur and/or chlorine containing organic lubricants comprising water, a water soluble or dispersible fatty acid or fatty acid salt, a water soluble or dispersible propylene oxide terminated ethylene oxide/propylene oxide copolymer having at least one terminal hydroxyl group or water soluble or dispersible derivative thereof, and a water soluble or dispersible phosphate ester.

DESCRIPTION OF INVENTION

In the context of this description and the appended claims the phrases "machining fluid composition", "machining fluid admixture" and "machining fluid" shall mean a material supplied to the interface between a workpiece and a workpiece shaping tool employed in and for the mechanical shaping of the workpiece. As used in the context of this description and the appended claims the term "synthetic aqueous fluid" shall mean an aqueous fluid having no mineral or petroleum based hydrocarbon oil and wherein the constituents of the fluid are dissolved (i.e. in true solution) in the aqueous phase and/or are dispersed in the aqueous phase in the form of a micro-emulsion having a particle size in the range of from about 0.1 micron to about 0.01 micron to visibly appear to be in true solution. The term "soluble" as employed in this description and the appended claims shall mean dissolvable in the aqueous phase to form a true solution. The term "dispersible" as used in this description and the appended claims shall mean being able to be dispersed in the aqueous phase so as to form a micro-emulsion which visibly appears to be a true solution. Further, in the context of this description and appended claims, the synthetic aqueous machining fluid admixture shall include mixtures of the recited constituents as well as reaction products resulting from mixing of said constituents and from mixing of the recited constituents with other components added to the synthetic aqueous machining fluid admixture. As used in this disclosure the terms "aqueous synthetic machining fluid admixture", "aqueous synthetic machining fluid composition" and "aqueous synthetic machining fluid" are used interchangeably and shall mean the aqueous synthetic machining fluid composition admixture in accordance with this description and the appended claims. As used in this description and the appended claims, sulfurized organic lubricant and halogenated organic lubricant shall include organic lubricants containing both sulfur and halogen atoms (e.g. sulfohalogenated lubricant), examples of such lubricants including without limitation sulfurized olefins, sulfurized fatty acids, sulfurized fatty acid esters, sulfurized fats and oils, sulfurized mineral, paraffinic and naphthenic oils, sulfochlorinated oils, sulfonated oils, chlorinated fatty acids and chlorinated fatty acid esters.

As used in this description and the appended claims, the terms "machining process" and "metalworking process" may be employed interchangeably. The term "workpiece" as used in this description and the appended claims shall mean that solid object being subject to a mechanical shaping or working process. Workpieces include metallic and non-metallic solid objects. Solid metal workpieces include for example iron, steel, aluminum, brass, copper, stainless steel, titanium and various alloys of these metals. Solid non-metallic workpieces include for example glass, ceramic and stone workpieces. The terms "machining" and "metalworking" as used in this description and the appended claims are intended and shall include and be interchangeable with one another. In the context of the heavy duty machining process in accordance with the invention described herein and claimed in the appended claims the phrase "mechanical shaping" shall mean shaping an article by applying a physical force to a workpiece by means of a solid object or tool so as to shape or alter the shape of the workpiece, the word "tool" shall mean a shaped solid object for applying a shaping force to the workpiece.

There is now provided in accordance with this invention a synthetic aqueous machining fluid composition free of sulfurized organic lubricant and halogenated organic lubricant and comprising in admixture a) water, b) at least one water soluble or dispersible organic phosphate ester, c) at least one water soluble or dispersible monocarboxylic aliphatic fatty acid or at least one water soluble or dispersible salt of a monocarboxylic aliphatic fatty acid or mixture thereof, and d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1. Further there is provided in accordance with this invention a synthetic aqueous machining fluid composition free of sulfurized organic lubricant and halogenated lubricant comprising in admixture a) water, b) at least one water soluble or dispersible organic phosphate ester, c) at least one water soluble or dispersible monocarboxylic aliphatic fatty acid, and d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1. Additionally there is provided in accordance with this invention a synthetic aqueous machining fluid composition free of sulfurized organic lubricant and halogenated organic lubricant comprising in admixture a) water, b) at least one water soluble or dispersible organic phosphate ester, c) at least one water soluble or dispersible salt of a monocarboxylic aliphatic fatty acid, and d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1. Still further there is provided in accordance with this invention a synthetic aqueous machining fluid composition free of sulfurized organic lubricant and halogenated organic lubricant comprising in admixture a) water, b) a water soluble or dispersible organic phosphate ester, c) at least one water soluble or dispersible monocarboxylic aliphatic fatty acid and at least one water soluble or dispersible salt of a monocarboxylic aliphatic fatty acid, and d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1.

Further yet there is provided in accordance with this invention a synthetic aqueous machining fluid composition free of sulfurized organic lubricant and halogenated organic lubricant comprising in admixture a) water, b) at least one water soluble or dispersible organic phosphate ester, c) at least one water soluble or dispersible monocarboxylic aliphatic fatty acid or at least one water soluble or dispersible salt of a monocarboxylic aliphatic fatty acid salt or mixture thereof, d) at least one soluble or dispersible propylene oxide terminated ethylene oxide/propylene oxide copolymer having at least one terminal hydroxyl group, wherein the weight ratio of b) to c) to d) is in the range of from about 0.15:0.20:1 to about 7:10:1. There is provided as an embodiment in accordance with this invention a synthetic aqueous machining fluid composition free of sulfurized organic lubricant and halogenated organic lubricant comprising in admixture a) water, b) a water soluble or dispersible organic phosphate ester, c) at least one water soluble or dispersible monocarboxylic aliphatic fatty acid, and d) at least one water soluble or dispersible propylene oxide terminated ethylene oxide/propylene oxide copolymer having at least one terminal hydroxyl group, wherein the weight ratio of b) to c) to d) is in the range of from about 0.15:0.20:1 to about 7:10:1. As a further embodiment of this invention there is provided a synthetic aqueous machining fluid composition free of sulfurized organic lubricant and halogenated organic lubricant comprising in admixture a) water, b) at least one water soluble or dispersible organic phosphate ester, c) at least one water soluble or dispersible salt of a monocarboxylic aliphatic fatty acid, and d) at least one water soluble or dispersible propylene oxide terminated ethylene oxide/propylene oxide copolymer having at least one terminal hydroxyl group, wherein the weight ratio of b) to c) to d) is in the range of from about 0.15:0.20:1 to about 7:10:1.

Another embodiment in accordance with this invention provides a synthetic aqueous machining fluid composition free of sulfurized organic lubricant and halogenated organic lubricant comprising in admixture a) water, b) at least one water soluble or dispersible organic phosphate ester, c) at least one water soluble or dispersible monocarboxylic aliphatic fatty acid having from 5 to 22, preferably from 5 to 12, carbon atoms or at least one water soluble or dispersible salt of a monocarboxylic aliphatic fatty acid having from 5 to 22, preferably 5 to 12, carbon atoms, or mixture thereof, and d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1, preferably from about 0.15:0.20:1 to about 7:10:1. In another embodiment of this invention there is provided a synthetic aqueous machining fluid composition free of sulfurized organic lubricant and halogenated organic lubricant comprising in admixture a) water, b) at least one water soluble or dispersible organic phosphate ester, c) at least one water soluble or dispersible monocarboxylic aliphatic fatty acid or at least one water soluble or dispersible salt of a monocarboxylic aliphatic fatty acid or mixture thereof, and d) at least one water soluble or dispersible propylene oxide terminated ethylene oxide/propylene oxide copolymer having at least one terminal hydroxyl group and an average molecular weight in the range of from about 1000 to about 8000, preferably from about 1800 to about 3500, wherein the weight ratio of b) to c) to d) is in the range of from about 0.10:0.15:1 to about 10:15:1.

In still another embodiment of this invention there is provided a synthetic aqueous machining fluid composition free of sulfurized organic lubricant and halogenated organic lubricant comprising in admixture a) water, b) at least one water soluble or dispersible organic phosphate ester, c) at least one water soluble or dispersible monocarboxylic aliphatic fatty acid having from 5 to 22, preferably from 5 to 12 carbon atoms or at least one water soluble or dispersible salt of a monocarboxylic aliphatic fatty acid having from 5 to 22, preferably 5 to 12 carbon atoms, or mixtures thereof and d) at least one water soluble or dispersible propylene oxide terminated ethylene oxide/propylene oxide copolymer having at least one terminal hydroxyl group and an average molecular weight in the range of from about 1000 to about 8000, preferably from about 1800 to about 3500, wherein the weight ratio of b) to c) to d) is in the range of from about 0.10:0.15:1 to about 10:15:1, preferably from about 0.15:0.20:1 to about 7:10:1.

There is provided in an even further embodiment of this invention a synthetic aqueous machining fluid composition free of sulfurized organic lubricant and halogenated organic lubricant comprising in admixture a) water, b) at least one water soluble or dispersible organic phosphate ester having at least one oxyalkylene group, c) at least one water soluble or dispersible monocarboxylic aliphatic fatty acid or water soluble or dispersible salt of a monocarboxylic aliphatic fatty acid or mixture thereof, and d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1, preferably from about 0.15:0.20:1 to about 7:10:1. In accordance with a further practice of this invention there is provided a synthetic aqueous machining fluid free of sulfurized organic lubricant and halogenated organic lubricant comprising in admixture a) water, b) at least one water soluble or dispersible organic phosphate ester having at least one oxyalkylene group, c) at least one water soluble or dispersible monocarboxylic aliphatic fatty acid having from 5 to 22, preferably 5 to 12, carbon atoms or at least one water soluble or dispersible salt of a monocarboxylic aliphatic fatty acid having from 5 to 22, preferably 5 to 12, carbon atoms, d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1, preferably from about 0.15:0.20:1 to about 7:10:1.

There is contemplated in accordance with the practice of this invention a synthetic aqueous machining fluid composition free of sulfurized organic lubricant and halogenated organic lubricant comprising in admixture a) water, b) at least one water soluble or dispersible organic phosphate ester having at least one oxyalkylene group, c) at least one water soluble or dispersible monocarboxylic aliphatic fatty acid or at least one water soluble or dispersible salt of a monocarboxylic aliphatic fatty acid or mixture thereof, d) at least one water soluble or dispersible propylene oxide terminated ethylene oxide/propylene oxide copolymer having at least one terminal hydroxyl group and an average molecular weight in the range of from about 1000 to about 8000, preferably from about 1800 to about 3500, wherein the weight ratio of b) to c) to d) is in the range of from about 0.10:0.15:1 to about 10:15:1, preferably from about 0.15:0.20:1 to about 7:10:1. It is further contemplated in the practice of this invention to provide a synthetic aqueous machining fluid composition free of sulfurized organic lubricant and halogenated organic lubricant comprising in admixture a) water, b) at least one water soluble or dispersible organic phosphate ester having at least one oxyalkylene group, c) at least one water soluble or dispersible monocarboxylic aliphatic fatty acid having from 5 to 22, preferably from 5 to 12, carbon atoms or at least one water soluble or dispersible salt of a monocarboxylic aliphatic fatty acid having from 5 to 22, preferably 5 to 12, carbon atoms, and d) at least one water soluble or dispersible propylene oxide terminated ethylene oxide/propylene oxide copolymer having at least one terminal hydroxyl group and an average molecular weight in the range of from about 1000 to about 8000, preferably from about 1800 to about 3500, wherein the weight ratio of b) to c) to d) is in the range of from about 0.10:0.15:1 to about 10:15:1, preferably from about 0.15:0.20:1 to about 7:10:1.

A preferred practice of this invention provides a synthetic aqueous machining fluid free of sulfurized organic lubricant and halogenated, more especially chlorinated, organic lubricant comprising in admixture a) water, b) poly(oxy-1,2-ethanediyl)alpha-isodecyl-omega hydroxy-phosphate, c) at least one water soluble or dispersible monocarboxylic aliphatic fatty acid having from 5 to 12 carbon atoms or at least one water soluble or dispersible salt of a monocarboxylic aliphatic fatty acid having from 5 to 12 carbon atoms, or mixture thereof, d) at least one water soluble or dispersible propylene oxide terminated ethylene oxide/propylene oxide copolymer having two terminal hydroxyl groups and an average molecular weight of from about 1800 to about 3500, wherein the weight ratio of b) to c) to d) is in the range of from about 0.10:0.15:1 to about 10:15:1, preferably from about 0.15:0.20:1 to about 7:10:1.

A method of heavy duty machining of metallic workpieces is provided by this invention that advantageously reduces or eliminates the need for cleaning (e.g. washing) the machined article to remove machining fluid residue prior to performing coating, painting, plating, welding and like operations on the machined article. Such heavy duty machining processes include for example punching, stamping, extruding, drawing, ironing and spinning operations which particularly embrace non-chip forming machining practices. Thus there is provided in accordance with this invention a method for heavy duty machining for producing mechanically shaped metal articles comprising the steps of 1) applying force to a metal workpiece by a tool contacting the workpiece, and 2) supplying to the interface between the tool and the workpiece a synthetic aqueous machining fluid composition free of sulfurized organic lubricant and halogenated organic lubricant comprising in admixture a) water, b) at least one water soluble or dispersible organic phosphate ester, c) at least one water soluble or dispersible monocarboxylic aliphatic fatty acid or at least one water soluble or dispersible salt of a monocarboxylic aliphatic fatty acid, or mixture thereof, and d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1. In one embodiment of the practice of the method according to this invention there is provided a heavy duty machining method for producing of mechanically shaped metal articles comprising the steps of 1) applying a force to a metal workpiece by a tool contacting the workpiece, and 2) supplying to the interface between the tool and a metal workpiece a synthetic aqueous machining fluid composition free of sulfurized organic lubricant and halogenated organic lubricant comprising in admixture a) water, b) at least one water soluble or dispersible organic phosphate ester, c) at least one water soluble or dispersible monocarboxylic aliphatic fatty acid having from 5 to 22, preferably 5 to 12, carbon atoms or at least one water soluble or dispersible salt of a monocarboxylic aliphatic fatty acid having from 5 to 22, preferably 5 to 12, carbon atoms, or mixtures thereof, and d) at least one water soluble or dispersible propylene oxide terminated ethylene oxide/propylene oxide copolymer having at least one terminal hydroxyl group, wherein the weight ratio of b) to c) to d) is in the range of from about 0.10:0.15:1 to about 10:15:1. Another embodiment of the practice of the heavy duty machining method of this invention provides a heavy duty machining method for producing mechanically shaped metal articles comprising the steps of 1) applying a force to a metal workpiece by a tool contacting the workpiece, and 2) supplying to the interface between the tool and the metal workpiece a synthetic aqueous machining fluid composition free of sulfurized organic lubricant and halogenated organic lubricant comprising in admixture a) water, b) at least one water soluble or dispersible organic phosphate ester, c) at least one water soluble or dispersible monocarboxylic aliphatic fatty acid or at least one water soluble or dispersible sale of a monocarboxylic aliphatic fatty acid or mixture thereof, and d) at least one water soluble or dispersible propylene oxide terminated ethylene oxide/propylene oxide copolymer having at least one terminal hydroxyl group and an average molecular weight in the range of from about 1000 to about 8000, preferably from about 1800 to about 3500, wherein the weight ratio of b) to c) to d) is in the range of from about 0.10:0.15:1 to about 10:15:1, preferably from about 0.15:0.20:1 to about 7:10:1. There is provided in accordance with another practice of this invention a heavy duty machining method for producing mechanically shaped metal articles comprising the steps of 1) applying a force to a metal workpiece by a tool contacting the workpiece, and 2) supplying to the interface between the tool and a metal workpiece a synthetic aqueous machining fluid composition free of sulfurized organic lubricant and halogenated organic lubricant comprising in admixture a) water, b) at least one water soluble or dispersible organic phosphate ester, c) at least one water soluble or dispersible monocarboxylic aliphatic fatty acid having from 5 to 22, preferably 5 to 12 carbon atoms or at least one water soluble or dispersible salt of a monocarboxylic aliphatic fatty acid having 5 to 22, preferably from 5 to 12, carbon atoms, or mixture thereof and d) at least one water soluble or dispersible propylene oxide terminated ethylene oxide/propylene oxide copolymer having at least on terminal hydroxyl group and an average molecular weight in the range of from about 1000 to about 8000, preferably from about 1800 to about 3500, wherein the weight ratio of b) to c) to d) is in the range of from about 0.10:0.15:1 to about 10:15:1, preferably from about 0.15:0.20:1 to about 7:10:1. A further embodiment of the practice of the heavy duty machining method of this invention provides a heavy duty machining method for producing mechanically shaped metal articles comprising the steps of 1) applying a force to a metal workpiece by a tool contacting the workpiece, and 2) supplying to the interface between the tool and the metal workpiece a synthetic aqueous machining fluid composition free of sulfurized organic lubricant and halogenated organic lubricant comprising in admixture a) water, b) poly(oxy-1,2-ethanediyl)alpha-isodecyl-omega hydroxy-phosphate, c) at least one water soluble or dispersible monocarboxylic aliphatic fatty acid having from 5 to 22, preferably from 5 to 12, carbon atoms or at least one water soluble or dispersible salt of a monocarboxylic aliphatic fatty acid having from 5 to 22, preferably from 5 to 12, carbon atoms, or mixture thereof, d) at least one water soluble or dispersible propylene oxide terminated ethylene oxide/propylene oxide copolymer having at least one terminal hydroxyl groups and an average molecular weight of from about 1000 to about 8000, preferably from about 1800 to about 3500, wherein the weight ratio of b) to c) to d) is in the range of from about 0.10:0.15:1 to about 10:15:1, preferably from about 0.15:0.20:1 to about 7:10:1.

Among the preferred heavy duty machining methods in accordance with this invention are stamping, drawing, ironing, extruding and spinning methods performed in accordance with this invention.

Water soluble or dispersible monocarboxylic aliphatic fatty acids or monocarboxylic aliphatic fatty acids forming water soluble or dispersible salts usable in the practice of the synthetic aqueous machining fluid and the heavy duty machining method in accordance with the invention include but are not limited to acetic, propionic, butyric, valeric, capric, pelargonic, caproic, lauric, myristic, oleic, stearic, palmitic, linoleic, behenic and sorbic acids. Preferably the fatty acid will have from 5 to 22, more preferably from 5 to 12 carbon atoms. Water soluble or dispersible salts of monocarboxylic aliphatic fatty acids that are usable in the practice of this invention include, but are not limited to: monoalkanolamine salts thereof, such as for example monoethanolamine, mono-butanolamine, monopropanolamine and monoisopropanolamine salts; dialkanolamine salts thereof, such as for example diethanolamine, and dipropanolamine salts; alkyl amine salts thereof, such as for example propylamine, butylamine, octylamine and hexylamine salts; alkylene polyamine salts thereof whereby the alkylene polyamine is characterized by the formula

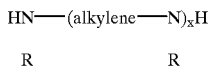

wherein x is an integer from 1 to about 5, R is hydrogen or hydrocarbon alkyl radical having from 1 to about 6 carbon atoms and the alkylene radical has from 2 to about 8 carbon atoms such as for example their ethylene diamine, propylene diamine, decamethylene diamine, octamethylene diamine, di(heptamethylene)triamine, triisopropylene tetramine, tetraethylene pentamine, pentaethylene hexamine, N,N-dimethyl aminopropyl amine and N-octyl-$N^1$ methylethylene diamine salts; and, polyoxyalkylene polyamine salts thereof whereby the polyoxyalkylene polyamine is characterized by the formula

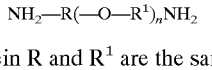

wherein R and $R^1$ are the same or different alkylene radicals having from 2 to about 4 carbon atoms and n is an integer in the range of from 1 to about 50 such as for example their salts of polyoxyalkylene triamines having an average molecular weight of from about 200 to about 4000, preferably from about 400 to about 2000, including for example polyoxyethylene diamines and poly[(oxyethylene)(oxypropylene)] diamines and salts. There may also be used commercially available polyoxyalkylene polyamines such as for example JEFFAMINE D-230, D-400, D-1000, D-2000 and T-403 obtained from the Jefferson Chemical Company as the water soluble or dispersible salts of fatty acids usable in the practice of this invention. JEFFAMINE is a registered trademark of the Jefferson Chemical Company.

There may be employed in the practice of this invention water soluble ammonium and alkali metal (e.g. sodium and potassium) salts of monocarboxylic aliphatic fatty acids such as for example ammonium, sodium and potassium salts of oleic, stearic, caproic, lauric and myristic acids. Mixtures of water soluble or dispersible monocarboxylic aliphatic fatty acids, water soluble or dispersible salts of monocarboxylic aliphatic fatty acids and water soluble or dispersible fatty acids and water soluble or dispersible salts of monocarboxylic aliphatic fatty acids may be employed in the practice of this invention.

The water soluble or dispersible propylene oxide terminated oxyethylene/oxypropylene copolymer employed in this invention may be a random or block copolymer having at least one terminal hydroxyl group. Thus the copolymer may have a central polyoxypropylene moiety terminated on both ends with polyoxyethylene moieties or the copolymer may have a central random or block oxyethylene/oxypropylene copolymer moiety terminated at both ends by a polyoxyethylene moiety. The copolymer may have terminal oxypropylene or oxyethylene moieties or one terminal oxypropylene and one terminal oxyethylene moiety. At least one terminal hydroxyl group is present in the oxyethylene/oxypropylene copolymer employed in the synthetic aqueous machining fluid composition admixture and the method of this invention. The molecular weight of the water soluble or dispersible oxyethylene/oxypropylene copolymer usable in the practice of this invention will depend upon the chemical structure of the copolymer and may have an average molecular weight in the range of from about 1000 to about 8000, preferably in the range of from about 1800 to about 3500. Water soluble or dispersible oxyethylene/oxypropylene copolymers having at least one terminal hydroxyl group usable in this invention have well known chemical structures. Methods well known in the art may be used to produce the water soluble or dispersible oxyethylene/oxypropylene copolymers having at least one terminal hydroxyl group usable in the synthetic aqueous machining fluid composition admixture and the heavy duty machining method of this invention.

Examples of water soluble or dispersible oxypropylene terminated oxyethylene/oxypropylene copolymers having at least one terminal hydroxyl group usable in the practice of this invention include, but are not limited to, commercially available oxyethylene/oxypropylene copolymers for example PLURONIC 10 R5 (average molecular weight of 1950, viscosity of 440 centipoises (cps) at 25° C.) available from BASF Corporation. Further examples include but are not limited to PLURONIC 31 R1, PLURONIC 25 R2, TETRONIC 90 R4 and TETRONIC 150 R1 available from BASF Corporation. PLURONIC and TETRONIC are registered trademarks of BASF Corporation.

There may be used in the practice of this invention a water soluble or dispersible derivative of an ethylene oxide/propylene oxide random or block copolymer having an average molecular weight of preferably 1000 to 8000, more preferably 1800 to 3500, that includes but is not limited to those obtained by modification of a terminal hydroxyl group by esterification or etherification. An example of which is the reaction of a lower aliphatic carboxylic acid or a lower alkyl halide with one or both terminal hydroxyl groups of a hydroxyl terminated ethylene oxide/propylene oxide copolymer having the general formula $$HO—(C_3H_6—O)_x(C_2H_4—O—)_y(C_3H_6—O)_zH$$

wherein x, y and z are whole numbers greater than zero such that x+y+z corresponds to the polymer having an average molecular weight in the range of from about 1000 to about 8000, by methods well known in the art to produce a modified ethylene oxide/propylene oxide copolymer having the general formula $$R^1—O(C_3H_6—O)_x(C_2H_4—O)_y(C_3H_6—O)_zR^2$$

wherein $R^1$ and $R^2$ are the same or different and are selected from the group consisting of hydrogen, $R^3$—C═, and $R^4$ (wherein $R^3$ and $R^4$ are the same or different alkyl groups), with the proviso that only one of $R^1$ and $R^2$ may be hydrogen and x, y and z have the same meaning as previously given herein and x+y+z has the same meaning as previously given herein. Preferably $R^3$ and $R^4$ are lower alkyl groups.

Water soluble or dispersible organic phosphate esters usable in the synthetic aqueous machining fluid composition admixture and the heavy duty machining method of this invention may be prepared by methods well known in the art. One such method is the esterification with phosphoric acid or phosphorus pentoxide of a condensation product obtained by reacting an alcohol with an alkylene oxide. Examples of water soluble or dispersible organic phosphate esters usable in the practice of this invention include, but are not limited to poly (oxy-1,2-ethanediyl) alpha-isodecyl-omega hydroxy phosphate, alpha (p-nonylphenyl) omega hydroxy poly (oxyethylene)phosphate, a mixture of alpha (p-nonylphenyl) omega hydroxy poly (oxyethylene)mono and dihydrogen phosphate esters, poly (oxy-1,2-ethanediyl) alpha (p-nonylphenyl) omega hydroxy phosphate, commercially available ethoxylated alkyl alcohol phosphate esters such as for example ETHFAC 136 and ETHFAC 161 obtainable from Ethox Chemicals, Inc. and RHODAFAC PE 510 obtainable from Rhone Poulenc Corporation. ETHFAC is a registered trademark of Ethox Chemicals, Inc. and RHODAFAC is a registered trademark of Rhone-Poulenc Corporation. There may be used alkyl phosphate esters, monoalkyl aryl phosphate esters, dialkyl aryl phosphate esters and trialkyl aryl phosphate esters including for example EMPHOS PS 236 obtainable from Witco Chemical Company. EMPHOS is a registered trademark of Witco Chemical Company. It is preferred in the practice of this invention to employ poly (oxy-1,2-ethanediyl) alpha-isodecyl-omega hydroxy phosphate.

Concentrations of water, water soluble or dispersible monocarboxylic aliphatic fatty acid or water soluble or dispersible salt of a monocarboxylic aliphatic fatty acid, water soluble or dispersible propylene oxide terminated ethylene oxide/propylene oxide copolymer having at least one terminal hydroxyl group and water soluble or dispersible organic phosphate ester in accordance with the synthetic aqueous machining fluid composition admixture and the heavy duty machining method of this invention may vary over a wide range with changing chemical composition of said monocarboxylic aliphatic fatty acid, salt of a monocarboxylic aliphatic fatty acid, propylene oxide terminated ethylene oxide/propylene oxide copolymer and organic phosphate ester constituents of the synthetic aqueous machining fluid composition admixture. Ranges of concentration of water soluble or dispersible monocarboxylic aliphatic fatty acid and/or water soluble or dispersible salt of a monocarboxylic aliphatic fatty acid and/or mixtures thereof that may be used in the practice of this invention are from about 0.25% to about 30%, preferably from about 0.25% to about 5%, by weight based on the total weight of the synthetic aqueous machining fluid composition admixture. A range of concentration of water soluble or dispersible propylene oxide terminated ethylene oxide/propylene oxide copolymer having at least one terminal hydroxyl group that may be used in the practice of this invention is from about 0.10% to about 30%, preferably from about 0.25% to about 5%, by weight based on the total weight of the synthetic aqueous machining fluid composition admixture. A water soluble or dispersible organic phosphate ester concentration in the range of from about 0.10% to about 20%, preferably from about 0.5% to about 3%, by weight based on the total weight of the synthetic aqueous machining fluid composition admixture, may be used in the practice of this invention. While the concentration of each constituent of the synthetic aqueous machining fluid composition admixture according to this invention may vary over a wide range with changes in the chemical composition of the constituent it is to be recognized that the concentration of each constituent in the fluid shall be consistent with the effective performance of the constituent and the fluid. The concentration of water in the synthetic aqueous machining fluid composition admixture in accordance with this invention may vary over the range of from about 5% to about 99%, preferably from about 10% to about 95%, by weight based on the total weight of the fluid.

In accordance with the synthetic aqueous machining fluid admixture of this invention there shall be a weight ratio of water soluble or dispersible organic phosphate ester (PE) to water soluble or dispersible monocarboxylic aliphatic fatty acid or water soluble or dispersible salt of a monocarboxylic aliphatic fatty acid or mixture thereof (FA) to water soluble or dispersible propylene oxide terminated ethylene oxide/propylene oxide copolymer having at least one terminal hydroxyl group (CP) in the range of from about 0.10:0.15:1 to about 10:15:1, preferably in the range of from about 0.15:0.20:1 to about 7:10:1. The weight ratio (PE:FA:CP) is obtained by dividing the weight of CP into the respective weights of PE and FA in the admixture. For example a synthetic aqueous machining fluid admixture in accordance with this invention containing 10 parts by weight of at least one water soluble or dispersible organic phosphate ester (PE), 15 parts by weight of at least one water soluble or dispersible monocarboxylic aliphatic fatty acid or at least one water soluble or dispersible salt of a monocarboxylic aliphatic acid or mixture thereof (FA) and 5 parts by weight of at least one water soluble or dispersible propylene oxide terminated ethylene oxide/propylene oxide copolymer having at least one terminal hydroxyl group (CP) would have a PE:FA:CP weight ratio of 2:3:1.

It is common practice in the art to prepare and ship aqueous machining fluid compositions in a concentrated form. Such concentrated form is then diluted with water to a use concentration by the end user (i.e. the user of the fluid) and the diluted fluid employed in the machining operation. The concentrated form of the fluid usually contains a small amount of water, typically less than 10% by weight. However larger amounts of water may be in the fluid composition prepared and shipped, which may then be diluted further with water to produce an end use concentration for the fluid. The advantage of preparing and shipping the concentrated form of the synthetic aqueous machining fluid composition is that it avoids sending large quantities of water from the producer of the fluid to the end user of the fluid since the end user can economically add water to the fluid to obtain the desired use concentration. Thus preparing and shipping the concentrated form of the synthetic aqueous machining fluid composition provides an economic advantage over preparing and shipping the fluid in an end use concentration. In the context of this description and the appended claims it is intended and shall be understood that this invention for a synthetic aqueous machining fluid composition admixture shall include the concentrated form thereof, the diluted form thereof suitable for end use and all concentrations there between.

Although many machining fluid compositions employed in the art are liquid that are fed into the tool/workpiece interface, it is known in some machining operations to coat the tool and/or the workpiece with a paste like composition such as for example in a tapping operation or to pre-apply a liquid or semi liquid to the blank and/or the punch and/or the die before contact is made as in a drawing or ironing process. The machining fluid in accordance with this invention may be prepared in consistencies required to be applied prior to machining or during machining as appropriate for a particular machining process.

There may be optionally added to the synthetic aqueous machining fluid composition admixture in accordance with this description and the appended claims various additives, in amounts conventionally known in art, such as for example, corrosion inhibitors, biocides, fungicides, bactericides, surfactants, antioxidants, anti-foaming agents, metal particle precipitating agents, shear stabilizing agents, dyes and odor masking agents as are well known in the art. It is preferred in the practice of this invention that these additives be water soluble.

Synthetic aqueous machining fluid composition admixtures in accordance with the invention described herein and claimed in the appended claims can be used in heavy duty metalworking operations to produce parts such as can be obtained from punching, drawing, ironing, extruding, spinning and stamping operations.

Methods and equipment well known in the art for preparing aqueous machining fluids may be used in making the synthetic aqueous machining fluid composition admixture in accordance with this invention. The various constituents of the synthetic aqueous machining fluid composition admixture may be combined in various orders. Thus each constituent may be added individually and blended, or two or more of the constituents may be combined and then the combination added and blended. Usually each constituent or blend of two or more constituents is added to the water constituent and thoroughly blended or mixed in before the next constituent or blend is added. While there may be no specific order of addition of each constituent the chemical and/or physical properties of each constituent may make it desirable and efficient to add each or a particular constituent in a defined sequence. Where dispersion of a constituent to produce a micro-emulsion is to be accomplished in accordance with the synthetic aqueous machining fluid composition admixture of this invention it is therefor necessary that the blending in of such constituent be sufficient to achieve the production of the micro-emulsion. It will be readily understood by those skilled in the art that various procedures may be employed in preparing the admixtures according to this invention and thus it is intended that the synthetic aqueous machining fluid composition admixture according to this invention shall not be limited by the manner of its preparation.

This invention will now be further described in the following non-limiting examples in which quantities of the components are percentages by weight, temperatures are in degrees centigrade and forces in pounds unless otherwise indicated.

| Fluid Composition Admixture No. 1 | |
|---|---|
| Phosphate ester (1) | 0.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 94.29 |
| Water | |

| Fluid Composition Admixture No. 2 | |
|---|---|
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 90.29 |
| Water | |

| Fluid Composition Admixture No. 3 | |
|---|---|
| Dimethyl octanoic acid | 1.13 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 94.04 |
| Water | |

| Fluid Composition Admixture No. 4 | |
|---|---|
| Dimethyl octanoic acid | 1.13 |
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 89.16 |
| Water | |

| Fluid Composition Admixture No. 5 | |
|---|---|
| Phosphate ester (1) | 0.88 |
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 89.41 |
| Water | |

| Fluid Composition Admixture No. 6 | |
|---|---|
| Phosphate ester (1) | 0.88 |
| Dimethyl octanoic acid | 1.13 |
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |

-continued

| | |
|---|---|
| Ethanolamines | 0.18 |
| Morpholine biocide | 1.00 |
| Mixed $C_{10}$ and $C_{11}$ dibasic acids | 88.28 |
| Water | |

Fluid Composition Admixture No. 7

| | |
|---|---|
| Phosphate ester (5) | 0.88 |
| Dimethyl octanoic acid | 1.13 |
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 88.30 |
| Water | |

Fluid Composition Admixture No. 8

| | |
|---|---|
| Phosphate ester (5) | 0.13 |
| Dimethyl octanoic acid | 1.13 |
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 89.00 |
| Water | |

Fluid Composition Admixture No. 9

| | |
|---|---|
| Phosphate ester (5) | 1.25 |
| Dimethyl octanoic acid | 1.13 |
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 87.90 |
| Water | |

Fluid Composition Admixture No. 10

| | |
|---|---|
| Phosphate ester (1) | 0.88 |
| Pelargonic acid | 1.13 |
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholene biocide | 1.00 |
| Mixed $C_{10}$ and $C_{11}$ dibasic acids | 88.30 |
| Water | |

Fluid Composition Admixture No. 11

| | |
|---|---|
| Phosphate ester (1) | 0.88 |
| Pelargonic acid | 0.13 |
| EO/PO copolymer diol (4) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 89.30 |
| Water | |

Fluid Composition Admixture No. 12

| | |
|---|---|
| Phosphate ester (1) | 0.88 |
| Pelargonic acid | 1.25 |
| EO/PO copolymer diol (4) | 4.88 |

-continued

| | |
|---|---|
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 88.20 |
| Water | |

Fluid Composition Admixture No. 13

| | |
|---|---|
| Phosphate ester (1) | 0.88 |
| Dimethyl octanoic acid | 1.13 |
| EO/PO copolymer diol (6) | 4.88 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 88.30 |
| Water | |

Fluid Composition Admixture No. 14

| | |
|---|---|
| Phosphate ester (1) | 0.88 |
| Dimethyl octanoic acid | 1.13 |
| EO/PO copolymer diol (6) | 0.13 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 93.00 |
| Water | |

Fluid Composition Admixture No. 15

| | |
|---|---|
| Phosphate ester (1) | 0.88 |
| Dimethyl octanoic acid | 1.13 |
| EO/PO copolymer diol (6) | 1.25 |
| Polyglycol ester (2) | 0.25 |
| EMULSOGEN 1222 (3) | 0.50 |
| Boric acid monoethanolamine | 1.15 |
| mixture | 0.75 |
| Potassium hydroxide | 1.00 |
| Ethanolamines | 0.18 |
| Morpholine biocide | 1.00 |
| Mixed $C_{10}$ and $C_{11}$ dibasic acids | 91.90 |
| Water | |

(1) Poly (oxy-1,2-ethanediyl) alpha-isodecyl-omega-hydroxy phosphate.
(2) An azaleic acid ester of a 400 molecular weight polyethylene glycol, having a viscosity of 7800 SUS at 137° F., an acid value of 140 and a specific gravity of 0.93.
(3) Tripropylene succinic acid and monoethanolamine salt - Clariant Corp. EMULSOGEN is a registered trademark of Clariant Corp.
(4) A propylene oxide terminated ethylene oxide/propylene oxide block copolymer diol having an average molecular weight of 1950 and viscosity of 440 centipoises (cps) at 25° C.
(5) ADDCO 410P - oxirane, methyl-, polymer with oxirane, monobutyl ether, phosphate available from the Gateway Additive Co., a Lubrizol Company. ADDCO is a registered trademark of the Gateway Additive Co.
(6) A propylene oxide terminated ethylene oxide/propylene oxide block copolymer diol having an average molecular weight of 2150 and a viscosity of 450 centipoises (cps) at 25° C.

A laboratory process simulating a metalworking process of a type within the scope of this disclosed and claimed invention has been carried out using a Tinius Olsen Ductomatic Sheet Metal Tester Model A12, available from the Tinius Olsen Testing Machine Company, and the Deep Draw Test Cup described in Section V of the Instruction Manual IB#70-6, published June 1970 by the Tinius Olsen Testing Machine Company, in conjunction with the AEG Flat Bottom Cup tooling described in the Instruction Manual and ACT cold rolled 1008 carbon steel having a thickness of 0.82 millimeters (mm). The metalworking process simulated in the laboratory with the Tinius Olsen Ductomatic Sheet Metal Tester Model A12 is a deep draw process for creating cup shaped metal articles. A blank diameter of 73 mm, punch diameter of 33 mm and a draw ratio of 2.2 were used. These tests were conducted in an ambient temperature ranging from about 73° F. to about 80° F.

In the aforesaid simulated deep draw process a metal blank (workpiece) is held (i.e. clamped) in place over a cup shaped die and a cup forming punch is brought into contact with and pressed against the blank to force the metal of the blank into the die to form a cup shaped metal article. This forming process was repeated on successive new blanks with increased clamping force applied to each new blank until failure (i.e. rupture of the metal during the forming of the cup shape) was obtained. A lubricating fluid was applied to both surfaces of each blank by brushing prior to carrying out the cup forming process. The clamping force, in pounds, on the blank when failure occurs was observed and recorded as the Critical Hold Down Force. The higher the clamping force that can be applied to the blank before failure (i.e. rupture) occurs during the cup forming operation the greater is the lubricity (i.e. capacity to reduce friction) of the lubricating fluid. The higher the lubricity of the lubricating fluid the greater is the capacity for the process employing such fluid to exhibit reduced tool wear and greater tool life.

The results obtained with the Fluid Composition Admixture Numbers 1 to 15 in the above described simulated metalworking process are given in the following table. Fluid Composition Admixture Numbers 1 to 5, 8 and 11 are not in accordance with this invention and are included as comparison examples. Fluid Composition Admixture Numbers 1 to 15 were diluted with water at 30% fluid composition admixture and 70% water by weight prior to being used in the above described simulated metalworking process.

| Fluid Composition Admixture No. | PE:FA:CP Weight Ratio | Critical Hold Down Force (lbs) |
|---|---|---|
| 1 | — | 200 |
| 2 | — | 600 |
| 3 | — | 900 |
| 4 | — | 900 |
| 5 | — | 700 |
| 6 | 0.18:0.23:1 | 1000 |
| 7 | 0.18:0.23:1 | 1600 |
| 8 | 0.027:0.23:1 | 800 |
| 9 | 0.26:0.23:1 | 1200 |
| 10 | 0.18:0.23:1 | 1300 |
| 11 | 0.18:0.027:1 | 600 |
| 12 | 0.18:0.26:1 | 1400 |
| 13 | 0.18:0.23:1 | 1400 |
| 14 | 6.77:8.69:1 | 1200 |
| 15 | 0.70:0.90:1 | 1400 |

What is claimed is:

1. A synthetic aqueous machining fluid composition free of sulfurized organic lubricant and halogenated organic lubricant comprising in admixture a) water;

b) at least one water soluble or dispersible organic phosphate ester;

c) at least one water soluble or dispersible monocarboxylic aliphatic fatty acid or at least one water soluble or dispersible salt of a monocarboxylic aliphatic fatty acid or mixture thereof; and d) at least one water soluble or dispersible propylene oxide terminated ethylene oxide/propylene oxide copolymer having at least one terminal hydroxyl group wherein the weight ratio of b) to c) to d) is in the range of from about 0.10:0.15:1 to about 10:15:1.

2. The admixture according to claim 1 wherein the fatty acid has from 5 to 22 carbon atoms.

3. The admixture according to claim 2 wherein the fatty acid has from 5 to 12 carbon atoms.

4. The admixture according to claim 1 wherein the salt of the fatty acid is an amine, alkanolamine, ammonium or alkali metal salt.

5. An admixture according to claim 4 wherein the salt is an amine or alkanolamine salt.

6. An admixture according to claim 1 wherein the propylene oxide terminated ethylene oxide/propylene oxide copolymer having at least one terminal hydroxyl group has an average molecular weight in the range of from about 1000 to about 8000.

7. An admixture according to claim 6 wherein the propylene oxide terminated ethylene oxide/propylene oxide copolymer having at least one terminal hydroxyl group has an average molecular weight in the range of from about 1800 to about 3500.

8. The admixture according to claim 1 wherein the water soluble or dispersible propylene oxide terminated ethylene oxide/propylene oxide copolymer has two terminal hydroxyl groups.

9. The admixture according to claim 1 wherein c) is a water soluble or dispersible fatty acid.

10. The admixture according to claim 1 wherein c) is a water soluble or dispersible amine, alkanolamine, ammonium or alkali metal salt of a fatty acid.

11. The admixture according to claim 9 wherein the fatty acid has from 5 to 22 carbon atoms.

12. The admixture according to claim 9 wherein the fatty acid has from 5 to 12 carbon atoms.

13. The admixture according to claim 10 wherein the fatty acid as from 5 to 22 carbon atoms.

14. The admixture according to claim 10 wherein the fatty acid has from 5 to 12 carbon atoms.

15. An admixture according to claim 1 wherein b) is poly (oxy-1,2-ethanediyl) alpha-isodecyl-omega hydroxy phosphate.

16. An admixture according to claim 1 wherein b) is a water soluble or dispersible organic phosphate ester, c) is a water soluble or dispersible monocarboxylic aliphatic fatty acid and d) is a water soluble or dispersible propylene oxide terminated ethylene oxide/propylene oxide copolymer having at least one terminal hydroxyl group.

17. An admixture according to claim 1 wherein b) is a water soluble or dispersible organic phosphate ester, c) is a water soluble or dispersible salt of a monocarboxylic aliphatic fatty acid and d) is a water soluble or dispersible propylene oxide terminated ethylene oxide/propylene oxide copolymer having at least one terminal hydroxyl group.

18. An admixture according to claim 16 wherein the fatty acid has from 5 to 22 carbon atoms, the ethylene oxide/propylene oxide copolymer has an average molecular weight in the range of from about 1000 to about 8000 and the weight ratio of b) to c) to d) is in the range of from about 0.15:0.20:1 to about 7:10:1.

19. An admixture according to claim 16 wherein the fatty acid has from 5 to 12 carbon atoms, the ethylene oxide/propylene oxide copolymer has an average molecular weight in the range of from about 1800 to about 3500 and the weight ratio of b) to c) to d) is in the range of from about 0.15:0.20:1 to about 7:10:1.

20. An admixture according to claim 18 wherein the organic phosphate ester is poly(oxy-1,2-ethanediyl)-alpha-isodecyl-omega hydroxy phosphate.

21. An admixture according to claim 17 wherein the fatty acid has from 5 to 22 carbon atoms, the ethylene oxide/propylene oxide copolymer has an average molecular weight in the range of from about 1000 to about 8000 and the weight ratio of b) to c) to d) is in the range of from about 0.15:0.20:1 to about 7:10:1.

22. An admixture according to claim 21 wherein the salt of a monocarboxylic aliphatic fatty acid is an amine, alkanolamine, ammonium or alkali metal salt.

23. An admixture according to claim 17 wherein the salt of a monocarboxylic aliphatic fatty acid is an amine or alkanolamine salt, the ethylene oxide/propylene oxide copolymer has an average molecular weight in the range of from about 1000 to about 8000 and the weight ratio of b) to c) to d) is in the range of from about 0.15:0.20:1 to about 7:10:1.

24. An admixture according to claim 17 wherein the salt of the fatty acid is the salt of a monocarboxylic aliphatic fatty acid having from 5 to 12 carbon atoms, the ethylene oxide/propylene oxide copolymer has an average molecular weight in the range of from about 1800 to about 3500 and the weight ratio of b) to c) to d) is in the range of from about 0.15:0.20:1 to about 7:10:1.

25. An admixture according to claim 23 wherein the fatty acid has from 5 to 22 carbon atoms.

26. An admixture according to claim 24 wherein the salt of the fatty acid is the alkanolamine salt.

27. An admixture according to claim 25 wherein the fatty acid has from 5 to 12 carbon atoms.

28. The admixture according to claim 21 wherein the organic phosphate ester is poly(oxy-1,2-ethanediyl)alpha-isodecyl-omega hydroxy phosphate.

29. A method for heavy duty machining for producing mechanically shaped metal articles comprising the steps of a) applying a force to a metal workpiece with a tool contacting the workpiece;

b) supplying to the interface between the tool and the workpiece a synthetic aqueous machining fluid composition free of sulfurized organic lubricant and halogenated organic lubricant comprising in admixture (1) water, (2) at least one water soluble or dispersible organic phosphate ester, (3) at least one water soluble or dispersible monocarboxylic aliphatic fatty acid or at least one water soluble or dispersible salt of a monocarboxylic aliphatic fatty acid or mixture thereof, (4) at least one water soluble or dispersible propylene oxide terminated ethylene oxide/propylene oxide copolymer having at least one terminal hydroxyl group wherein the weight ratio of (2) to (3) to (4) is in the range of from about 0.10:0.15:1 to about 10:15:1.

30. A method according to claim 29 wherein the monocarboxylic aliphatic fatty acid has from 5 to 12 carbon atoms.

31. A method according to claim 29 wherein the ethylene oxide/propylene oxide copolymer has an average molecular weight in the range of from about 1000 to about 8000.

32. The method according to claim 29 wherein the salt of the monocarboxylic aliphatic fatty acid is an amine, alkanolamine, ammonium or alkali metal salt.

33. The method according to claim 29 wherein the fatty acid has from 5 to 22 carbon atoms, the ethylene oxide/propylene oxide copolymer has an average molecular weight in the range of from about 1000 to about 8000 and the weight ratio of (2) to (3) to (4) is in the range of from about 0.15:0.20:1 to about 7:10:1.

34. The method according to claim 33 wherein the salt is an amine or alkanolamine salt of a monocarboxylic aliphatic fatty acid.

35. A method according to claim 34 wherein the organic phosphate ester is poly(oxy-1,2-ethanediyl) alpha-isodecyl-omega hydroxy phosphate.

36. A method according to claim 29 wherein the tool is a tool for a metal stamping process.

37. A method according to claim 29 wherein the tool is a tool for a metal punching process.

38. A method according to claim 29 wherein the tool is a tool for a metal drawing process.

39. A method according to claim 29 wherein the tool is a tool for a metal spinning process.

40. A method according to claim 29 wherein the tool is a tool for a metal extruding process.

* * * * *